US009674615B2

(12) United States Patent
Fan

(10) Patent No.: US 9,674,615 B2
(45) Date of Patent: Jun. 6, 2017

(54) MOVING COIL MODULE COMPRISING A SUBSTRATE PATTERNED WITH A CONDUCTOR TRACE

(71) Applicant: WALL AUDIO INC., San Jose, CA (US)

(72) Inventor: Chiko Fan, Oakland, CA (US)

(73) Assignee: WALL AUDIO INC., San Jose, CA (US)

( * ) Notice: Subject to any disclaimer, the term of this patent is extended or adjusted under 35 U.S.C. 154(b) by 226 days.

(21) Appl. No.: 14/588,073

(22) Filed: Dec. 31, 2014

(65) Prior Publication Data

US 2015/0195655 A1 Jul. 9, 2015

Related U.S. Application Data

(60) Provisional application No. 61/924,042, filed on Jan. 6, 2014.

(51) Int. Cl.
*H04R 9/06* (2006.01)
*H04R 9/02* (2006.01)
(Continued)

(52) U.S. Cl.
CPC ..... *H04R 9/027* (2013.01); *H04R 1/00* (2013.01); *H04R 9/025* (2013.01); *H04R 9/047* (2013.01);
(Continued)

(58) Field of Classification Search
CPC . H04R 9/00; H04R 9/04; H04R 9/041; H04R 9/045; H04R 9/047; H04R 9/048; H04R 31/00; H04R 31/006
(Continued)

(56) References Cited

U.S. PATENT DOCUMENTS 4,856,071 A 8/1989 Marquiss
5,452,663 A 9/1995 Berdut
(Continued)

FOREIGN PATENT DOCUMENTS

EP 2677769 A2 12/2013
WO WO-2015103421 A1 7/2015

OTHER PUBLICATIONS

Notice of allowance dated Mar. 6, 2015 for U.S. Appl. No. 29/478,511.

(Continued)

*Primary Examiner* — Paul S Kim
*Assistant Examiner* — Katherine Faley
(74) *Attorney, Agent, or Firm* — Wilson Sonsini Goodrich & Rosati

(57) ABSTRACT

A linear moving coil magnetic drive system includes a continuous loop coil of flat, thin, rigid construction which levitates inside a quadrupole permanent magnet assembly with minimum gap. The linear coil may be a flat, racetrack-shaped, continuous loop, which may be constructed with single or multilayers PCB, flex-circuit, or other membrane process. The linear coil may include a coating of permeable magnetic material along the insulated conductor traces. The linear coil may be sandwiched between carbon fiber fabrics and cured to create a long, flat, thin and perfectly straight, extremely stiff, light-weight, load-bearing tee-shaped structure. This structure is levitated inside a quadrupole permanent magnetic assembly with minimum air gap between the high gauss magnets. In additional to the bare conductor traces inside this coil, also integrated into this PCB structure, is simple second-order equalizer electronic circuitry, comprised of surface-mounted resistors, capacitors, and IC chips. Either a close loop or open loop control may be
(Continued)

included to tune the voltage amplitude at the resonance frequency of this magnetic drive system.

20 Claims, 10 Drawing Sheets

(51) Int. Cl.

| | |
|---|---|
| ***H04R 1/00*** | (2006.01) |
| ***H04R 31/00*** | (2006.01) |
| ***H04R 9/04*** | (2006.01) |
| *H04R 1/02* | (2006.01) |
| *H04R 7/10* | (2006.01) |

(52) U.S. Cl.
CPC ..... *H04R 9/06* (2013.01); *H04R 31/00* (2013.01); *H04R 1/023* (2013.01); *H04R 7/10* (2013.01)

(58) Field of Classification Search
USPC ..... 381/400–412, 419
See application file for complete search history.

(56) References Cited

U.S. PATENT DOCUMENTS

| | | | | |
|---|---|---|---|---|
| D432,518 | S | 10/2000 | Muto | |
| D592,641 | S | 5/2009 | Ryu et al. | |
| D628,913 | S | 12/2010 | Cheng | |
| D636,188 | S | 4/2011 | Kim et al. | |
| D639,568 | S | 6/2011 | Lee et al. | |
| D652,418 | S | 1/2012 | Rashid et al. | |
| 8,335,339 | B2 | 12/2012 | Tagami et al. | |
| D676,430 | S | 2/2013 | Blaser | |
| D685,346 | S | 7/2013 | Szymanski et al. | |
| D695,250 | S | 12/2013 | Kim et al. | |
| D707,204 | S | 6/2014 | Fujiwara et al. | |
| D719,744 | S | 12/2014 | Plumbo et al. | |
| D721,893 | S | 2/2015 | Gorham | |
| D722,049 | S | 2/2015 | Moradian | |
| 8,958,591 | B2 | 2/2015 | Hagman | |
| 2002/0171526 | A1* | 11/2002 | Laskaris et al. | 336/110 |
| 2002/0191808 | A1* | 12/2002 | Croft et al. | 381/431 |
| 2004/0089929 | A1* | 5/2004 | Chiu et al. | 257/678 |
| 2005/0059256 | A1* | 3/2005 | Watanabe | 438/725 |
| 2008/0205686 | A1* | 8/2008 | Tagami et al. | 381/398 |
| 2010/0316242 | A1* | 12/2010 | Cohen et al. | 381/337 |

OTHER PUBLICATIONS

Artcoustic Picture Gallery (Artcoustic UK LTD.) Jul. 6, 2012; https://web.archive.org/web/20130706004612/http://www.artcoustic.com/Gallery.html Published Jul. 6, 2012; Downloaded from Wayback Mar. 16, 2015.

International search report and written opinion dated Mar. 25, 2015 for PCT/US2014/073054.

Standard Specification for Silver Coated Copper Wire (ASTM B298) Sep. 9, 2013; http://www.astm.org/Standards/B298.htm. Published Sep. 9, 2013; Downloaded from Wayback on Mar. 6, 2015.

U.S. Appl. No. 29/478,511, filed Jan. 6, 2014, Fan.

U.S. Appl. No. 29/495,837, filed Jul. 3, 2014, Fan.

DSA. Dedicated Sound and Audio homepage. Innovative Audio Concepts. Accessed Jan. 16, 2015. http://dsausa.com/.

DSA. Dedicated Sound and Audio Technology: How it works. Accessed Jan. 16, 2015. http://dsausa.com/tech-nology.

Morcos, Tony. The straight attraction, part two. The Magnequench Technology Center. Jul. Aug. 2000 Motion Control, pp. 24-28.

Planar Magnetic Technology. Technical Overview, Wisdom Audio, 2007.

Notice of allowance dated Apr. 29, 2015 for U.S. Appl. No. 29/495,837.

* cited by examiner

MOVING COIL MODULE COMPRISING A SUBSTRATE PATTERNED WITH A CONDUCTOR TRACE

CROSS-REFERENCE

This application claims the priority of U.S. Provisional Application Ser. No. 61/924,042, filed Jan. 6, 2014, which is incorporated herein by reference in its entirety.

BACKGROUND OF THE INVENTION

Loudspeakers' general construction includes a diaphragm, typically a thin film attached to a frame under tension, an electrical circuit, and magnetic sources creating a flux field adjacent to the diaphragm. Electrical current is applied to the circuit, which interacts with the magnets and causes a vibration of the diaphragm, which produces the sound from an electro-dynamic loudspeaker.

Several difficulties in loudspeaker design, manufacturing and materials have presented challenges to be overcome. The diaphragm material and construction needs to achieve an optimum or desired resonance frequency, with minimal or reduced changes in frame attachment or tension occurring during extended operation, while minimizing or reducing any sound distortion, damping or frequency loss to deliver an extended bandwidth of sound. For many speakers, the conductor (i.e. coil) in electro-dynamic loudspeakers is attached directly to the thin diaphragm, necessitating that the conductor be constructed of a material having a low mass and be securely attached to the diaphragm by high temperature and power (large current). The diaphragm is then driven when current passes through the conductor within a magnetic field creating a motive force.

Prior conductor construction has been done by winding 32 AWG magnetic wire (solid copper with thin epoxy coating, either heat or solvent activation) into a "race-track" oval. The limitation of this coil size is approximately six inches due to pre-stress in the wire and an increasingly lower yield and poor performance. Wire breakage is a problem and the number of "race-track turns" is reported to be about 56 turns before the wire pre-stress makes it impossible to achieve the flatness required for use in proximity to the magnets and within the magnetic flux field required.

Transducers of substantially rigid planar diaphragms present a challenge to current electro-magnetic drive systems and specifically to linear moving coils by presenting a low impedance to the amplifier which reduces high fidelity performance by not driving the transducers properly.

Loudspeaker enclosures, rear-planar-surfaces, or multiple transducer positioning have been configured and used to compensate for acoustic problems of backwaves, cancellation "dead spots", and frequency damping all causing undesirable resonances or other loss of sound quality. The space limitations and configuration of a wide variety of listening environments have presented a big challenge to past designers of loudspeakers and audio systems to try to create a system and known directivity pattern. These specifications are then delivered to the user to compensate by locating or mounting speakers in such a way to avoid the limitations inherent in the design. Size and space constraints of a particular environment have made it difficult in the past to achieve the desired performance from traditional audio systems.

Loudspeakers include a frame that supports magnets used to move the coils, the diaphragm and the terminal, consequently, has faced its own design difficulties. It has to bond to the diaphragm, be rigid enough to maintain uniform tension. Ferrous frames in the past had the advantage of being capable of carrying magnetic energy or flux. Another alternative was using a plastic frame with spring-loaded inserts to achieve very precise control of the separation distance between the top of the embedded magnets and the film conductor. The plastic frames overcame the difficulties of increased weight and could compensate for magnet lots with high thickness variation which allowed cost-savings in the magnet specifications. Plastic frames also helped to address the design capability by minimizing the mean separation distance between driver and magnets.

Historically, loudspeaker technology has relied on a single magnet, dual pole drive system, which resulted in a flux field that was non-linear and limited the dynamic response of the speaker. This non-symmetrical operation is also seen with single ring magnets (adapted for driving traditional cone-shaped speaker diaphragms) and dual pole electro-magnetic drive units, due to the differences in mass, size and configuration of the pole pieces again giving a non-linear pistonic action of the moving coil.

A need exists for an improved loudspeaker having a high performance linear moving coil magnetic drive system.

SUMMARY OF THE INVENTION

Systems and methods are provided relating to the field of loudspeakers, and more specifically, to improvements for loudspeakers and related manufacturing methods. Other related applications in this field, for example vibration shaker tables and material conveying belts, will benefit from these systems and methods which fill the requirements for super-light-weight, limited operational space, high force density, high frequency operation, needing precise and short linear motion with controlled feedback in an electromechanical system.

The loudspeaker may be a planar loudspeaker including include a high performance linear moving coil and stationary magnetic drive design which may solve one or more of the issues with traditional loudspeakers, while contributing new progress in the field of rigid planar diaphragm and electro-magnetic drive technologies. The conductor may be removed from the diaphragm and suspended between bars of magnets which may enable new materials and manufacturing methods to create a planar loudspeaker that achieves new levels of acoustic performance. A driver can be suspended between magnets with minimal or reduced separation as disclosed herein.

The loudspeakers that include one or more of the features described herein can be used in a variety of settings and ways according to a user's wishes. In one embodiment, the speakers can be mounted on the living room wall, in their "flat-panel photo-frames", on either side of a flat-panel television set. The audio performance does not require attention to directivity or special "box" enclosures or mounting.

The high performance linear moving coil magnetic drive system herein described may include a quadrupole magnetic assembly, a carbon fiber encapsulated linear moving coil, a diaphragm, a frame and materials, manufacture and method of use thereof.

Methods may be provided for selecting the permanent magnet composition and size specification to provide sufficient magnetic flux for driving the linear moving coil. The magnets (e.g., FIG. 1A, item 2) may be positioned in a frame (e.g., FIG. 1A, 1B, 2A, 2B, item 1) that may be metal, plastic, wood, or other material to affix and hold in place strong magnets with minimal spacing between rows of magnets (e.g., FIG. 2A, item 3). A preferable embodiment may include a frame of ferrous metal that can enhance magnet positioning, affixation and the resultant flux field. There may be four rows of magnets, two on one side of a central frame bar, two on the opposing side of the central frame bar (e.g., FIG. 2B, item 2), in a quadrupole arrangement (e.g., FIG. 2B, item 2, showing North and South poling of magnets). The magnets may also be held in place by an adhesive, a flange, metal alloy solder or other technique.

The magnets may include a first magnet(s) affixed to the frame in a first row and a second magnet(s) affixed to the frame in a second row. Each of the first and second rows may be a plurality of magnets end-to-end or longitudinally, or in a plurality of rows. Magnets may be positioned in the first row with polarity that is opposite to the polarity of the magnets positioned in the second row. Each of the magnets may include a first surface that is coplanar with an inner surface of the frame and a second surface of the magnets that extends into the frame towards an outer surface of the frame.

A high performance linear moving coil (e.g., FIG. 3A, 3B, 4A, 4B) may be mounted to the diaphragm (FIG. 5B) to achieve a determined distance from the magnets. The rows of magnets may produce one or more magnetic fields between them as produced by electrical signals passing through the conductor coil that is attached to the diaphragm. The moving coil may be a racetrack coil constructed of metal traces on printed circuit board (PCB) material such as FR4, flex-circuitry membrane materials, Mylar, or other flexible or semi-rigid materials and may include an electronic device or component, or other electrical connection. In one embodiment, the target resistance value is 8 ohm nominal. An equalizer circuit to tune the voltage at any frequency may be included in another embodiment. In another embodiment, a metallic and/or ferromagnetic finely ground particulate may be applied to enhance the magnetic interaction within the quadrupole magnetic field. The linear moving coil may be enclosed between two unidirectional carbon fiber sheets of fabric, two L-shapes to bring together into a T-shape (e.g., FIG. 4A, 4B), with impregnated material enhancements and final assembly curing steps. One embodiment may position the linear coil between the rows of magnets where it vibrates and levitates according to the electrical current and magnetic flux. The coil may return to its original central neutral position after an internal or external force is applied. The movement can be stabilized in low frequency excitation (fast bass). Other embodiments can optimize the dynamics of the loudspeaker for small size, large commercial use, or small-space acoustic dynamics for specific targets such as auto interior or aircraft speakers.

The diaphragm (e.g., FIG. 5A, 5B) may include a thin film, a thick film, a man-made material such as Kevlar fiber fabric, unidirectional carbon fiber fabric, a natural material such as cork or Corecork, Dyvincell or Rohacell foam or a combination of layered materials (e.g., FIG. 5A, item 11, 12). The film may be movable in response to the moving coil force created by interaction between the magnetic fields produced by the magnets and the magnetic field produced with the electrical signals. The resulting movement of the film may produce sound. The diaphragm may be surrounded by a frame (e.g., FIG. 6A) with the encapsulated PCB-type coil in the approximate center (e.g., FIG. 6A, item 16) attached to the composite sound panel sub-assembly (e.g., FIG. 6A, item 15) with a rubber foam material (e.g., FIG. 6A, item 17) providing particulate protection for the moving coil and magnet spacing, and resonant stabilization and attachment to the frame.

The moving coil (e.g., FIG. 5, item 16) may be attached to the diaphragm (FIG. 5, item 15), and very precisely oriented for suspension between the magnet sub-assemblies (e.g., FIG. 2A, 2B) by the frame piece (e.g., FIG. 7A, item 21) that may be constructed of wood or other materials. There are two circular magnets in each of the corners of the frame recessed area (e.g., FIG. 7B, item 19) which may be on the opposite side from the attachment of the metal magnet-carrying bars (e.g., FIG. 1A). These smaller, corner magnets may serve a purpose of attaching a special, removable, customizable art-on-silk cover (e.g., FIG. 8B, item 22) that faces away from the wall or other surface on which the speaker may be mounted.

Additional aspects and advantages of the present disclosure will become readily apparent to those skilled in this art from the following detailed description, wherein only illustrative embodiments of the present disclosure are shown and described. As will be realized, the present disclosure is capable of other and different embodiments, and its several details are capable of modifications in various obvious respects, all without departing from the disclosure. Accordingly, the drawings and description are to be regarded as illustrative in nature, and not as restrictive.

INCORPORATION BY REFERENCE

All publications, patents, and patent applications mentioned in this specification are herein incorporated by reference to the same extent as if each individual publication, patent, or patent application was specifically and individually indicated to be incorporated by reference.

BRIEF DESCRIPTION OF THE DRAWINGS

The novel features of the invention are set forth with particularity in the appended claims. A better understanding of the features and advantages of the present invention will be obtained by reference to the following detailed description that sets forth illustrative embodiments, in which the principles of the invention are utilized, and the accompanying drawings of which:

DETAILED DESCRIPTION OF THE INVENTION

The invention provides systems and methods for controlling movement of a diaphragm in a loudspeaker in accordance with aspects of the invention. Various aspects of the invention described herein may be applied to any of the particular applications set forth below or for any other types of audio systems. The invention may be applied as a standalone system or method, or as part of an integrated loudspeaker system. It shall be understood that different aspects of the invention can be appreciated individually, collectively, or in combination with each other.

A loudspeaker may include a diaphragm which may be attached to a frame under tension. Vibration of the diaphragm produces sound from the loudspeaker. A moving coil module may be suspended from the diaphragm and positioned between portions of a magnet assembly. The magnet assembly can create a magnetic field that aids in the control of movement of the moving coil module as current passes through a conductor trace of the moving coil module, thus effecting vibration of the diaphragm.

Figure 1A:
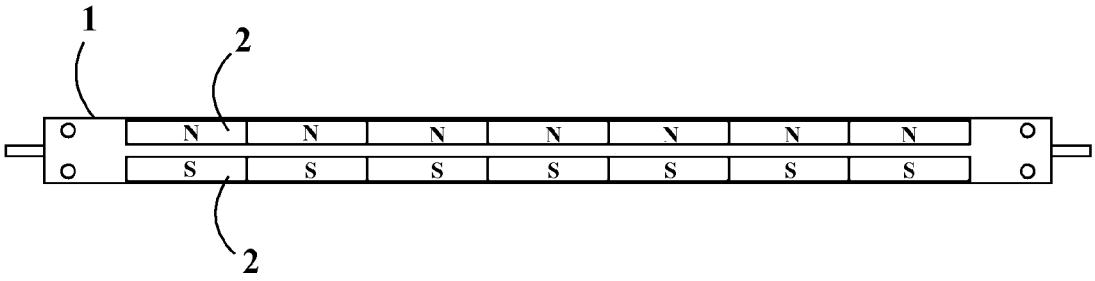
FIG. 1A shows an example of a front view of a magnetic poles in-line assembly in accordance with an embodiment of the invention.

FIG. 1A is the front view of a portion of a magnet assembly in accordance with an embodiment of the invention. The magnet assembly may include a magnet support frame 1 and a two-pole magnetic pole in-line assembly with permanent magnets 2.

The magnet support frame 1 may be a T-bar, which may be formed from steel, any ferrous metal or metal alloy, any other metal or metal alloy, plastic, wood, or any other material or combinations of materials or composites, natural or man-made, including those described elsewhere herein. The T-bar may include two substantially planar portions that may be orthogonal to one another. One of the orthogonal portions planar portions may connect to a central planar region of the other planar portion, thus forming a T cross-section. The magnet support frame may be formed from a single integral piece or multiple pieces that may be connected to one another.

One or more magnets 2 may be disposed on the magnet support frame 1. The magnets may be composed of neodymium, or other high gauss permanent magnets (e.g., magnets of other rare earth elements or electrical enhancement that create a powerful magnetic flux). The magnets may optionally be formed as bars.

In some embodiments, one, two or more rows of magnets 2 may be disposed on the magnet support frame. For example, two rows of magnets may be provided on the magnet support frame. The rows may be substantially parallel to one another. In some embodiments, the first row may include one or more magnets, each of which have a magnetic poling designated as North N on its exposed surface and the second row may include one or more magnets, each of which have a magnetic poling designated as South S on its exposed surface. Any description herein of a polarity or magnetic poling of a magnet herein may refer to an exposed surface of the magnet (i.e., surface of the magnet opposing the side of the magnet that contacts the magnet support frame). For example, a reference to a magnet having a polarity or magnetic poling designated as North N may mean the exposed surface has a polarity or magnetic poling of N while a reference to a magnet having a polarity or magnetic poling designated as South S may mean the exposed surface has a polarity or magnetic poling of S.

Each of the magnets within the same row may have the same magnetic poling (e.g., their exposed surfaces opposing the surface contacting the magnet support frame may have the same polarity). Each row of magnets may have different magnetic poling from its adjacent row. In some embodiments, each row may include a single longitudinally extended magnet. In other embodiments, each row may include a plurality of magnets longitudinally connected to one another. The plurality of magnets within the row may each directly contact one another. Alternatively, space may be provided between the magnets. Any number of magnets may be provided in a row. For example, one, two, three, four, five, six, seven, eight, nine, ten, eleven, twelve, thirteen, fourteen, fifteen or more magnets may be provided in a row.

Figure 1B:
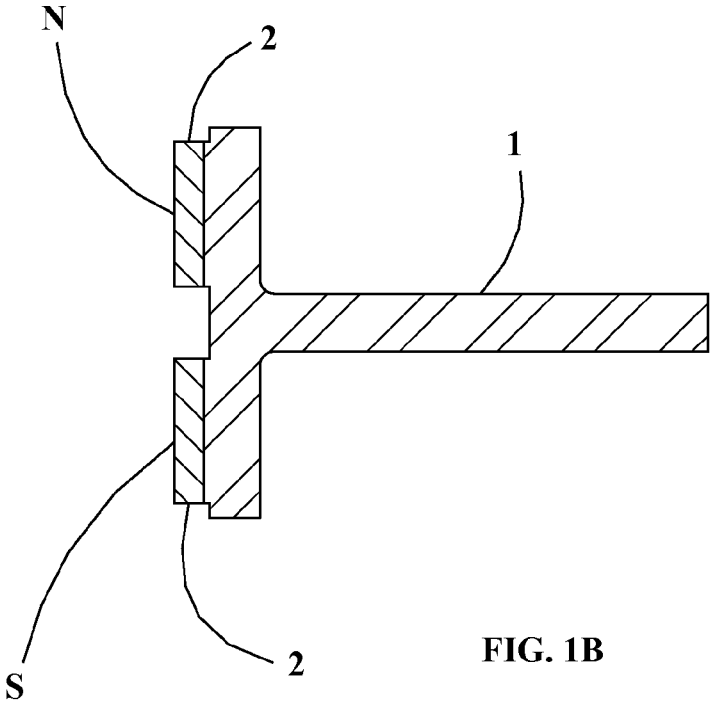
FIG. 1B shows a cross-sectional view of the magnetic poles in-line assembly shown in FIG. 1A.

FIG. 1B is the cross sectional view of the portion of the magnet assembly of FIG. 1A with magnetic poling designated as North N and South S. The magnet assembly may include a magnet support frame 1, such as a T-bar, and one or more magnets 2 supported by the magnet support frame. The magnets may form a plurality of rows on the T-bar. In some instances, a first row may be provided on a planar surface of the T-bar, and a second row may be provided on the same planar surface of the T-bar. The planar surface may or may not be completely flat. In embodiments one or more grooves or ledges may be provided. For example, a groove may be provided between the rows of magnets. An orthogonal planar portion of the T-bar may be attached to an opposing side of the portion of the T-bar relative to the side contacting the rows of magnets. The orthogonal planar portion may be located between the rows of magnets.

The rows of magnets may have different magnetic polarities. For example, a first row of magnets may have a poling designated as North N while a second row of magnets may have a poling designated as South S.

The magnets 2 may be attached to the magnet support frame 1 using any known technique, such as an adhesive, flange, locking mechanism, mechanical connector, solder (e.g., metal alloy solder), or any other technique. The magnets may be permanently affixed to the magnet support frame.

Figure 2A:
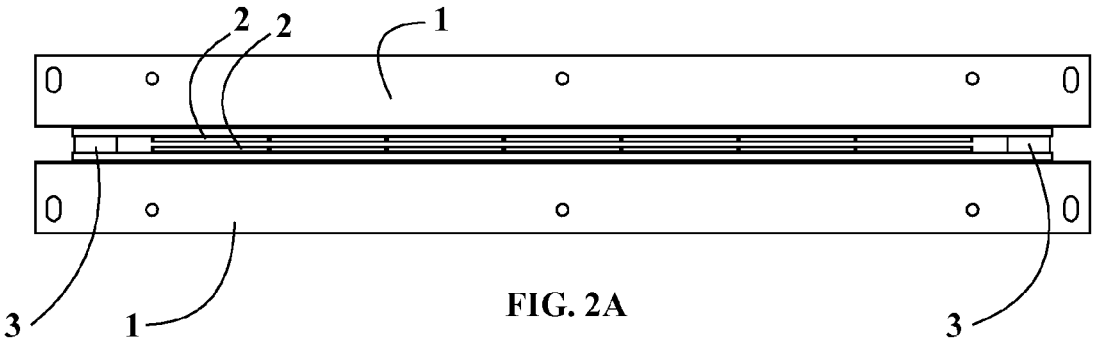
FIG. 2A shows a view of magnetic poles in-line assemblies put together and separated by at least one spacer.

FIG. 2A is a cross sectional side view of a magnet assembly. The magnet assembly may include two magnetic poles in-line assemblies put together and separated by one or more non-ferromagnetic spacers or non-ferromagnetic screws and nuts 3. Each magnetic pole in-line assembly may include a magnet support frame 1 and one or more magnets 2 affixed thereto. Each magnetic pole in-line assembly may optionally be a two-pole magnetic pole in-line assembly having two rows of magnets with different polarities.

The magnet assembly may include any number of magnetic pole in-line assemblies, which may include a T-bar magnet support frame 1 and one or more magnets 2. For instance, one, two, three, four or more magnet pole in-line assemblies may be provided. In some examples, the magnet assembly may include two magnet pole in-line assemblies facing one another, so the sides with the magnets are closest to one another. For example, a surface of the magnet support frame supporting the magnets may be facing the surface of the other magnet support frame supporting the magnets. The magnets may be aligned so that the rows from a first magnet pole in-line assembly are opposing the rows from a second magnet pole in-line assembly. The arrangement may include one or more planes of symmetry. For example, a first plane of symmetry may pass through a portion of the magnet support frames for each of the magnetic pole in-line assemblies that are orthogonal to the portion of the magnet support frames contacting the magnets (e.g., the bottom portion of the 'T'). A second plane of symmetry may be provided between the magnets (e.g., between the top portion of the 'T's).

One or more spacers 3 may be provided between the magnetic pole in-line assemblies. The one or more spacers may be formed from a non-ferromagnetic material. For example, a spacer may be composed of aluminum, non-ferromagnetic metal, non-ferromagnetic screws and nuts, wood, plastic, or other material without magnetic properties, that meets specifications for strength, weight, resonance, cost, aesthetics or other criteria. The spacers may affix the positions of the rows of magnets relative to one another. The spacers may affix the positions of the rows of magnets supported by different magnet support frames relative to one another. The spacers may affix the positions of the magnet support frames relative to one another. The spacers may cause the magnets to remain a predetermined distance apart. The spacers may permit an air gap to form between the rows of magnets. The air gap may remain the same dimension during the use of the magnet assembly.

These spacers may provide a high level of precision needed for the separation of the two magnetic T-bar assemblies in order to enhance/focus the magnetic line density to the air gap that will receive the suspended moving coil described in FIGS. 3 & 4. This configuration forms a quadrupole magnetic field air gap in the middle of the magnet assembly.

Figure 2B:
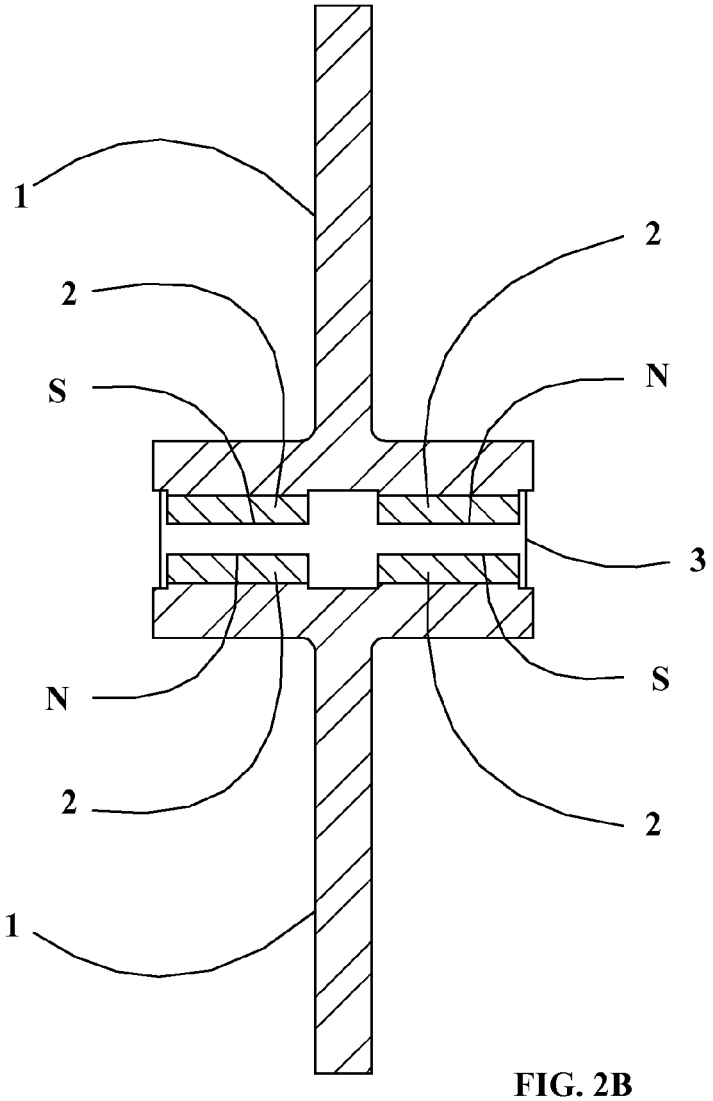
FIG. 2B shows a cross-sectional view of the magnetic poles in-line assemblies shown in FIG. 2A.

FIG. 2B is the cross-sectional view of the magnet assembly FIG. 2A. The magnet assembly may include a pair of magnetic pole in-line assemblies. Each magnetic pole in-line assembly may have a T-bar magnet support frame 1 and one or more rows of magnets 2 supported by each T-bar magnet support frame. Preferably, two rows of magnets may be supported on each T-bar magnet support frame. The magnetic pole in-line assemblies may be oriented so the portions with the magnets are facing one another. One or more spacers 3 may be provided between the magnetic pole in-line assemblies.

Each row of magnets on the T-bar magnetic support frame may have a different polarity from the row of magnets adjacent to it. For example, a first row of magnets may have a North N orientation (e.g., magnetic poling of N on its exposed surface) while a second row of magnets supported on the same support frame may have a South S orientation (e.g., magnetic poling of S on its exposed surface). Each row of magnets on a T-bar magnetic support frame may have a different polarity from the row of magnets directly opposing it on a different T-bar magnetic support frame. For example, a first row of magnets on a first magnetic support frame may have a North N orientation while a first row of magnets on a second magnetic support frame that directly opposes the first row of magnets on the first magnetic support frame may have a South S orientation. A second row of magnets on the first magnetic support frame may have a South S orientation while a second row of magnets on the second magnetic support frame that directly opposes the second row of magnets on the first magnetic support frame may have a North N orientation. This may form a quadrupole magnetic field.

One or more non-ferromagnetic spacers 3 may be provided between the magnetic pole in-line assemblies. The spacers may be provided between the magnet support frames 1. The spacers may contact a surface of the magnet support frame. The spacers may contact surfaces of the pair of the magnet support frames that are facing one another. In some embodiments, a first spacer may be provided between a pair of support frames on a first side, and a second spacer may be provided between the pair of support frames on a second side. The first side and the second side may be on opposing sides of the rows of magnets. An air gap may be provided between the pair of magnetic pole in-line assemblies. An air gap may be provided between the rows of magnets supported by different magnet support frames. Optionally, an air gap may be provided between rows of magnets supported by the same magnet support frames.

In some instances, the exposed surfaces of the magnets supported by different magnet support frames (e.g., belonging to different magnetic pole in-line assemblies) may be substantially parallel to one another. The exposed surfaces may be very close together. For example, the gap between the exposed magnet surfaces may be less than or equal to about 70 mm, 60 mm, 50 mm, 40 mm, 30 mm, 20 mm, 10 mm, 8 mm, 6 mm, 5 mm, 4 mm, 3 mm, 2 mm, 1 mm, or 0.5 mm.

Figure 3A:
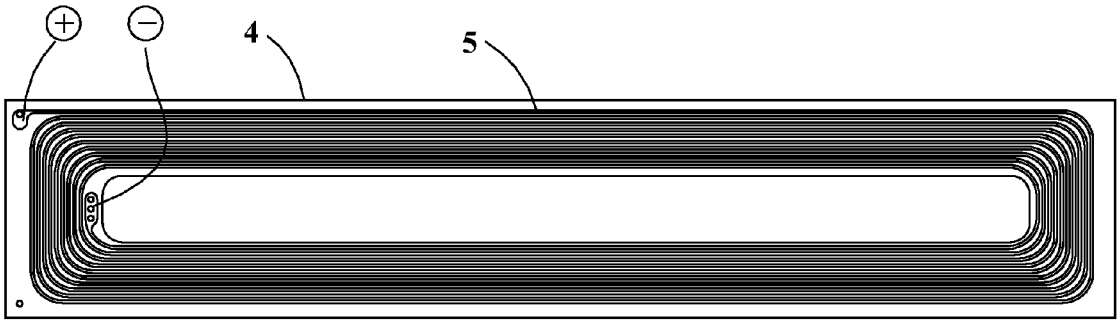
FIG. 3A shows a coil layout including a conductor trace on a printed circuit board in accordance with an embodiment of the invention.

FIG. 3A shows a portion of a moving coil assembly. The moving coil assembly may a printed circuit board (PCB) substrate 4 and a conductor trace 5 formed thereon.

The PCB substrate 4 may comprise a high-temperature substrate material that can withstand up to 130 degrees Celsius during a bake process for 2.5 hours, for example FR-4. The PCB substrate may be formed from FR-4, low density ceramic, flex-circuitry membrane materials, Mylar, or other flexible or semi-rigid materials that may include an electronic device or component or other electrical connection. In some embodiments, alternative substrates may be used. Any reference to a "PCB" substrate herein may also be applied to any other substrate (i.e. which need to be PCB), such as other less rigid and/or non-conventional materials. In some embodiments, any reference to a "PCB" substrate may apply to any substrate of rigid, semi-rigid, or flexible material upon which conductor traces may be provided (e.g., deposited, printed, etched). A substrate may be formed from an electrically insulating material. Optionally, the PCB substrate may withstand up to 100 degrees C., 125 degrees C., 150 degrees C., 175 degrees C., or 200 degrees C. during the bake process. The bake process may occur during the manufacture of this portion of the moving coil assembly to achieve desired mechanical properties in an encapsulated carbon fiber fabric portion to be described in greater detail further herein. In some embodiments, the PCB may be formed of laminates, copper-clad laminates, resin impregnated B-stage cloth, or copper foil.

A conductor trace 5 may be formed on the PCB substrate 4. The conductor trace may have a racetrack shaped coil layout. The conductor trace may be formed as metalized trace lines, which may be copper, silver, aluminum, or other metals or composites, occurring in a single or multiple layers, on top the PCB substrate. The conductor trace may be a copper, silver, or aluminum trace. Alternatively, the conductor trace may be another metal, metal alloy, or composite material optionally with high electrical conductivity (e.g., higher or equal to the conductivity of copper). The conductor trace may have a length between 1 and 100 meters. For example, the conductor trace may be greater than or equal to about 8 meters, 10 meters, 12 meters, 15 meters, 20 meters, or 25 meters long. The conductor trace may be at 2 to 16 ohm with a number of turns between 1 to 1000 turns, 10 to 500 turns, or 20 to 100 turns. For example, the number of turns may be greater than or equal to about 5 turns, 10 turns, 15 turns, 20 turns, 25 turns, 30 turns, 32 turns, 35 turns, 37 turns, 40 turns, 45 turns, 50 turns, 55 turns, 60 turns, 70 turns, or 80 turns. Optionally, the conductor trace may less than 40 turns, 45 turns, 50 turns, 55 turns, 60 turns, 70 turns, 80 turns, 100 turns, 200 turns, 300 turns, or 500 turns. Providing conductor traces on a PCB substrate permits long length of the conductor traces with little or minimal mechanical stress.

The conductor traces can be etched from material on the PCB or deposited on the PCB to form desired patterns on the PCB board, thereby providing a large degree of flexibility. Alternatively, the conductor traces may be embedded or partially embedded into the PCB substrate. In some embodiments, the conductor traces may have a constant wire cross sectional area. Alternatively, the conductor traces may have a variable wire cross sectional area to control the current density, which may optimize or improve a reactant magnetic field. The conductor traces may be flat and precisely machined to a desired/correct shape. The high tolerance and high precision may lead to a small magnetic gap, which may provide high efficiency. Furthermore, this may be easy to automate in high volume production. Electrical connection wires, 32 AWG copper, silver coated, PVDF insulated may also be included (not shown).

The length, width, and thickness and precise dimensional controls may be used to control the total impedance of the loudspeaker. These dimensions may be designed to control the magnetic field density at the same time to match the permanent magnetic air-gap. A method of forming a portion of a moving coil assembly may include selecting a desired total impedance or desired characteristics of a magnetic field. In response to the desired total impedance or desired characteristics of the magnetic field, one or more dimensions of a PCB substrate may be selected. Furthermore, one or more dimensions or arrangement of conductor traces on the PCB substrates may be selected. The conductor traces may be formed on the PCB substrate in response to the selection. For example, the conductor traces may be printed or etched into the PCB substrate in response to the selection. In one embodiment, a conductive material coating may be added to the conductor trace to decrease the impedance of the trace for improved performance at higher sound frequencies. Any selection described herein may be made with an aid of one or more processors. For instance, one or more processors may individually or collectively may make a calculation as described herein based on a desired magnetic field and/or acoustic property of the loudspeaker.

Figure 3B:
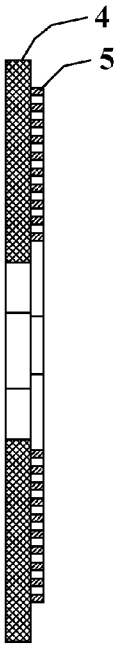
FIG. 3B shows a cross-sectional view of the conductor trace and printed circuit board shown in FIG. 3A.

FIG. 3B is the cross sectional view of the PCB substrate 4 and conductor trace 5. In some embodiments, the conductor trace may be a copper trace provided on the PCB substrate. The conductor traces may form a racetrack shaped coil. Spaces may be provided between each portion of the coil so that the conductor trace forms a single line that does no intersect itself. In some instances, a single layer of conductor trace is provided to form a coil. In some instances at least a single layer of conductor trace is provided. Alternatively, multiple layers of conductor trace may be provided. A portion of the coil need not contact any other portion of the coil. In some instances, the spacing may be provided evenly between each wind of the coil. In some instances, the width of the spacing may be greater than or equal to a width of the conductor trace. Alternatively, the width of the spacing may be less than or equal to a width of the conductor trace. The PCB substrate may be formed from a single continuous solid piece. Alternatively, one or more holes may be provided on the PCB substrate. In some embodiments, the PCB substrate may have a hole in the middle of the racetrack shaped coil of the conductor traces. In some embodiments, insulation may be provided by a standard PCB process, which may remove or reduce problems in electrical shorting.

Figure 4A:
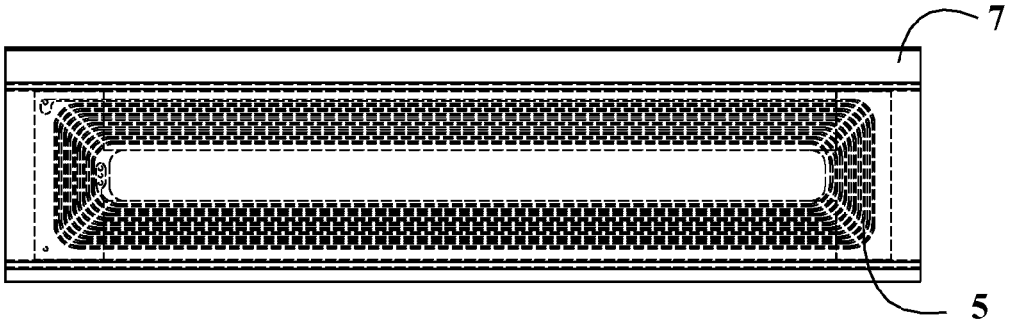
FIG. 4A shows a moving coil module in accordance with an embodiment of the invention.
Figure 4B:
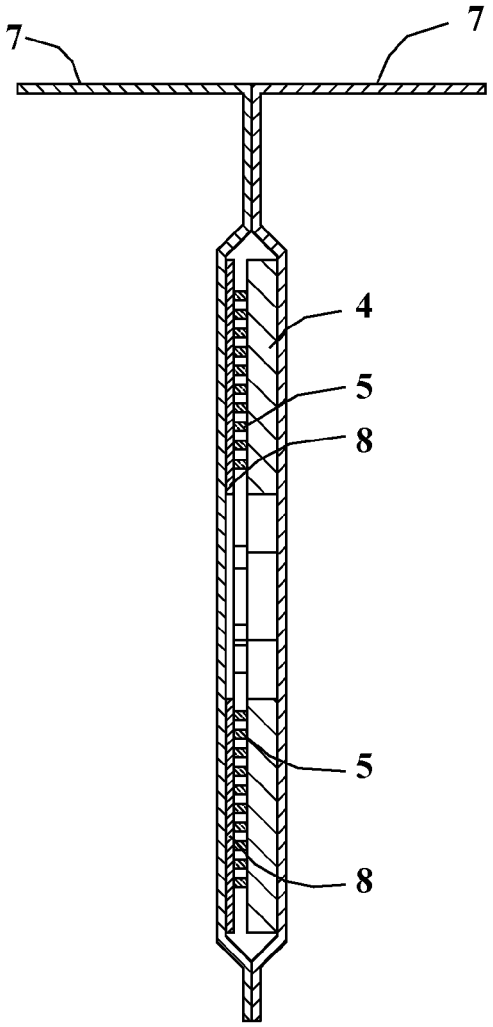
FIG. 4B shows a cross-sectional view of the moving coil module of FIG. 4A.

FIG. 4A shows a moving coil module in accordance with an embodiment of the invention. FIG. 4B shows a cross-sectional view of the moving coil module. The moving coil module may include the PCB 4 with the conductor traces 5 as previously described. The moving coil module may also include a cover forming a rigid support structure that may enclose the PCB with the conductor traces.

The cover may optionally form a T-shaped surface 7 for attaching to a diaphragm (e.g., diaphragm of a loudspeaker). The cover may enclose the PCB 4 and traces 5 by sandwiching them between layers of the cover. The cover may fold over the PCB and traces, or may be connected around the perimeter of the PCB and traces. For instance, two L-shapes may be brought together to form the T-shape. The cover may come together and then split into orthogonal portions to form the T-shaped (e.g., the split portion may form the top of the 'T'). The split portion may contact a surface of the diaphragm. The other portion enclosing the PCB and traces (e.g., the bottom portion of the 'T') may be substantially orthogonal to the diaphragm surface.

The cover may be formed from a non-conductive material. The cover may permit very little or no electrical conduction. The cover and support material may be formed from a carbon fiber fabric. The carbon fiber fabric may be unidirectional carbon fiber fabric sheets. In some embodiments, the coil cover and support material may be carbon fiber fabric that is unidirectional, plane, twill or other weave.

The moving coil module may also include ferromagnetic strips with conformal coating or layer 8. The ferromagnetic strips may also be enclosed by the cover. The ferromagnetic strips may contact the conductor traces 5. For example, the ferromagnetic strips may be sandwiched between the conductor traces and the cover. The dimensions (e.g., length, width, thickness) and/or shape of the ferromagnetic strips may be selected to provide a desired magnetic property. The ferromagnetic strips may aid in tuning levitation force and focus the external magnetic field. In some embodiments, the ferromagnetic strips may be formed from steel, or another metal or metal alloy with ferromagnetic properties. In some instances, a ferromagnetic powder coating, such as an iron powder coating, may be used in place of the ferromagnetic strips or in addition to the ferromagnetic strips.

The cover and/or support fabric may be coated or impregnated with a special formulation organic material that is compatible with high temperatures to form a rigid cross-linked polymer, such as epoxy. One embodiment may comprise two layers of carbon fiber fabric (e.g., unidirectional carbon fiber fabric) with specific orientation which are affixed together in order to sandwich the PCB assembly and form a T-shape structure of flange for attaching to the diaphragm. The treatment, baking and use of a carbon fiber fabric can achieve exceptional dimensional stability, strength, stiffness, fatigue resistance, high heat transfer and protection for the PCB coil. It can also be lightweight with max tensile strength.

FIG. 4B is the cross sectional view of the cured and stiffened covering containing the moving coil. Two ferromagnetic strips 8 may focus the permanent magnetic field line through the encapsulated PCB coil structure 5. This arrangement may create a magnetic levitation effect of the PCB coil in an air gap between magnetic pole in-line assemblies. The moving coil module may be located within an air gap of a magnet assembly, as illustrated further herein (e.g., FIG. 7C, 7D). This may enable the PCB coil to quickly return to the original position inside the air gap after external excitation such as large bass signal to optimize sound quality.

Figure 5A:
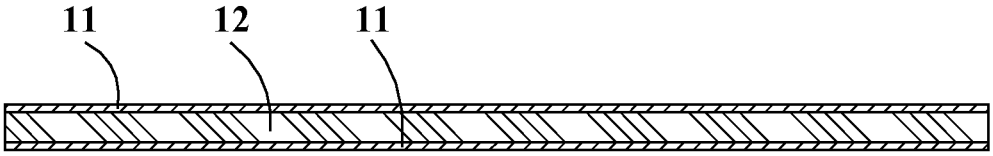
FIG. 5A shows a diaphragm in accordance with an embodiment of the invention.

FIG. 5A is the side view of the diaphragm in accordance with an embodiment of the invention. The diaphragm may be formed of a diaphragm composite having a middle core 12 and one or more other layers 11. Optionally, a diaphragm may include a thin film, thick film, man-made material such as Kevlar fiber fabric, carbon fiber fabric, natural or synthetic material such as cork, Rohacell, Dyvincell foam core or a combination of layered materials.

The middle core 12 of the diaphragm may include polyvinyl chloride (PVC) foam core, Rohacell, Dyvincell, Corecork, or other specific structure material. In some embodiments, the middle core may be formed as a single layer of a single material or type of material. Alternatively, the middle core may include two or more layers which may be formed of the same material or type of material, or may be formed of different materials or types of materials.

The middle core 12 may be covered, coated or fused with another material to form the one or more other layers 11. The other layers may include Kevlar-like fiber fabric, unidirectional carbon fiber fabric or other materials to enhance various frequency response. In some instances, another layer may be formed on only one side of the middle core. Alternatively, the other layers may be provided on both sides of the middle core. Layers on both sides of the middle core may include the same materials, or may include different materials.

Figure 5B:
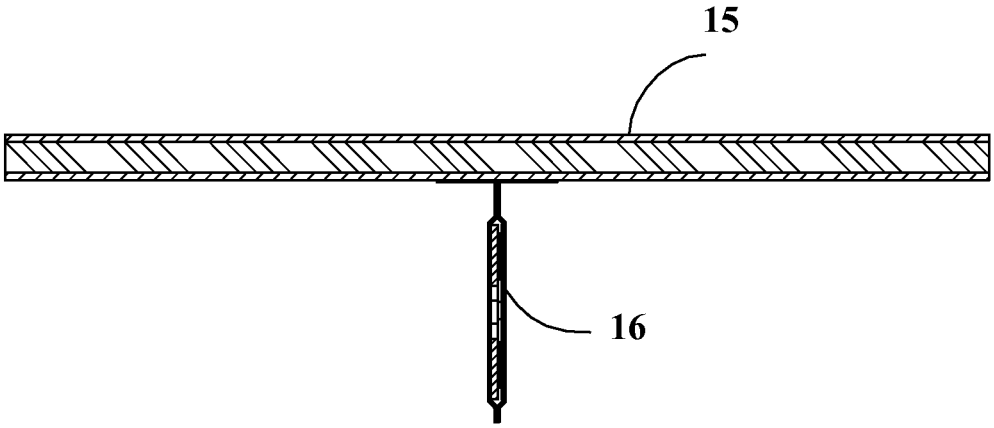
FIG. 5B shows the diaphragm attached to a moving coil module.

FIG. 5B is a cross-section of the diaphragm 15 attached to a moving coil module (a.k.a. moving core module) 16. The moving coil module may be encapsulated. The encapsulated portion of the moving coil module may be substantially orthogonal to the diaphragm. In some instances, the moving coil module may be attached to the diaphragm via use of adhesive, soldering, mechanical connection, or any other technique. Although a single moving coil module is depicted as being attached to the diaphragm, multiple moving coil modules may optionally be attached in other embodiments of the invention. The number and/or placement of the moving coil modules on the diaphragm may be selected to provide a desired acoustical effect.

Figure 6A:
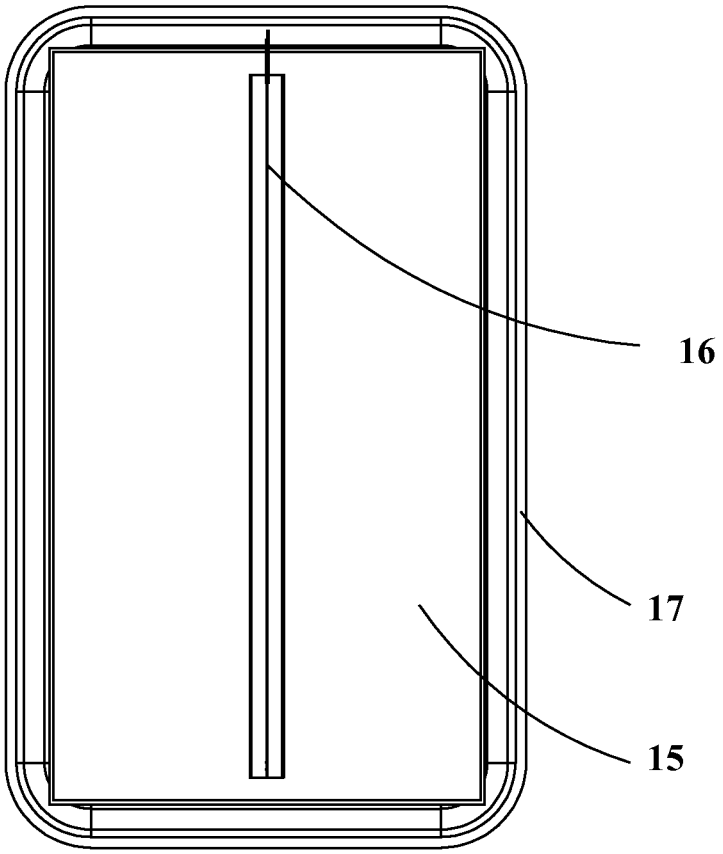
FIG. 6A shows a composite sound panel assembly in accordance with an embodiment of the invention.

FIG. 6A shows a top view of a composite sound panel assembly in accordance with an embodiment of the invention. The composite sound panel assembly may include a diaphragm 15, with the moving coil module 16 mounted, and surrounded by an edge material 17. In some embodiments, the moving coil module may form a strip that may be placed on the diaphragm. In some instances, the moving coil module may be positioned at a central region of the diaphragm. The edge material may comprise rubber foam or other protecting and dampening materials.

Figure 6B:
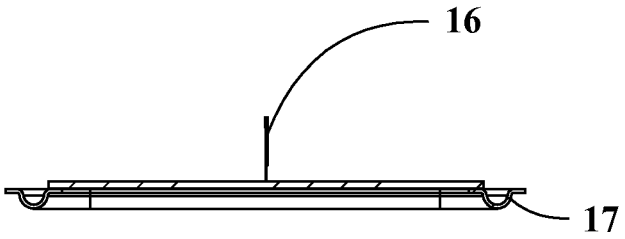
FIG. 6B shows a cross-sectional view of the composite sound panel assembly.

FIG. 6B shows a cross sectional view of the composite sound panel assembly. A portion of the moving coil module 16 that encapsulates a coil may be substantially orthogonal to a diaphragm surface. The edge material 17 may surround the diaphragm and may optionally form a U-shaped trough around the circumference of the diaphragm.

Figure 7A:
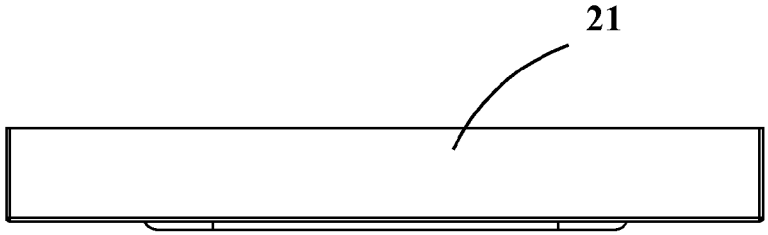
FIG. 7A shows a side view of a support frame in accordance with an embodiment of the invention.

FIG. 7A shows a side view of a support frame 21 in accordance with an embodiment of the invention. The support frame may be formed from any material or combination of materials, such as any variety of wood, metal, man-made material, plastic, or composite. In some instances, the support frame may be formed from a rigid or semi-rigid material. The support frame may form an exterior surface or portion of an exterior surface for a loudspeaker. The dimensions of the support frame may be selected to provide a desired design. In some instances, a loudspeaker may be a planar loudspeaker, where the width and length of the loudspeaker may substantially exceed a thickness of the loudspeaker. For example, the ratio of the width and/or length of the loudspeaker to the thickness of the loudspeaker may be greater than or equal to 2:1, 3:1, 4:1, 5:1, 6:1, 7:1, 8:1, 9:1, 10:1, 12:1, 15:1, 20:1, 40:1, 60:1, 80:1, 100:1, or 200:1.

Figure 7B:
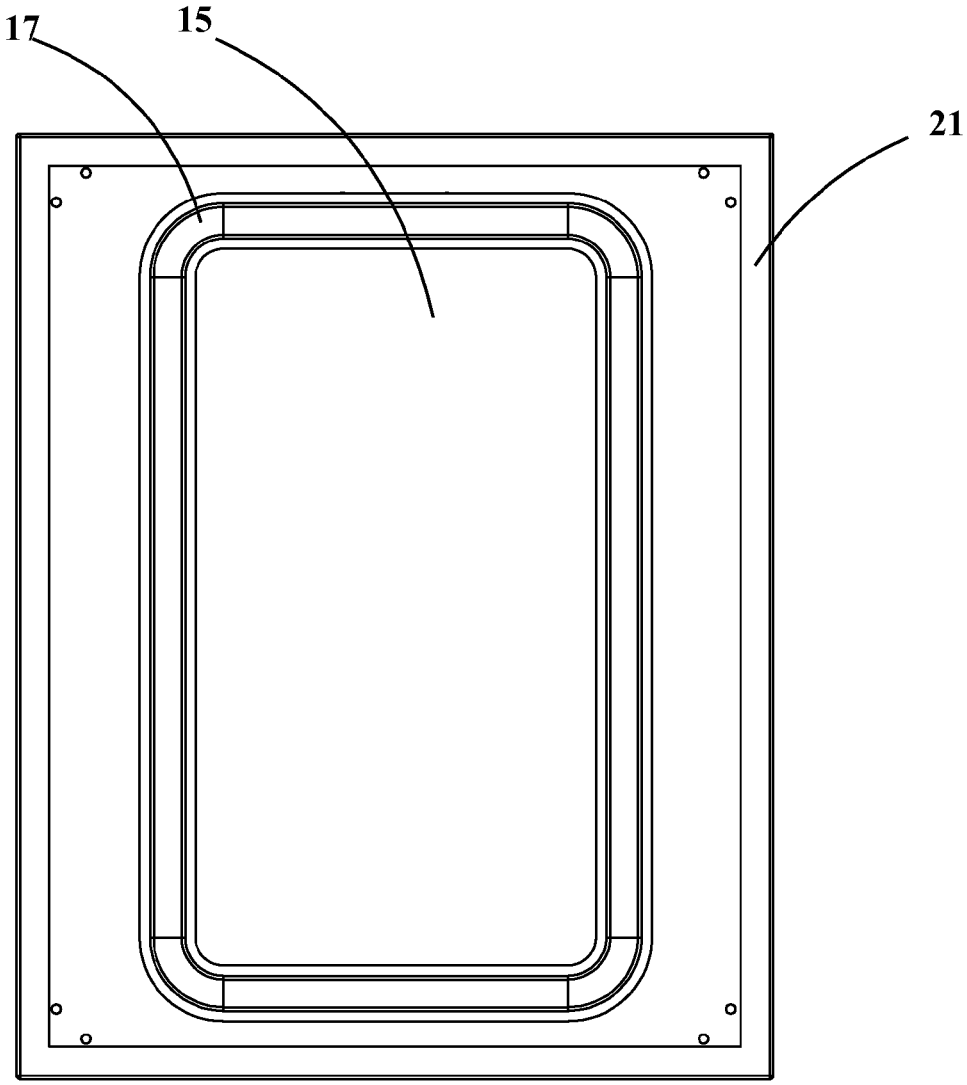
FIG. 7B shows a top view of the support frame in accordance with an embodiment of the invention.

FIG. 7B shows a top view of the support frame 21 in accordance with an embodiment of the invention. The top view of the support frame 21 can show the placement and location in one embodiment of the composite sound panel assembly including the diaphragm 15, and the edge material 17 that surrounds the edge of the diaphragm.

FIG. 7B also shows the approximate location of art cover attachment points, shown as two circles in each corner. The art cover attachment points may comprise a recessed inner frame containing circular magnets, Velcro, adhesives, screws or other variety of fasteners, for either permanent or temporary attachment of a protective or artistic cover, which may be made from silk material for acoustic and light transmission properties (e.g., FIG. 8C, 8D). The protective or artistic cover may be mounted on the opposite side of the composite sound panel assembly from the side having the attachment of the magnet assembly (e.g., FIG. 1A) in a flat-panel, wall-mount loudspeaker. These corner attachments in a recessed area of the frame may serve the purpose of attaching a special, removable, customizable cover which may include art-on-silk acoustically matched to the speaker and faces away from the wall (or other surface) on which the loudspeaker may be mounted in one embodiment.

Figure 7C:
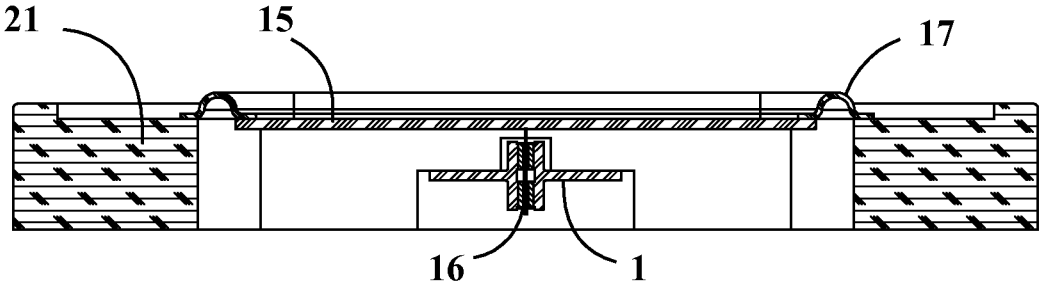
FIG. 7C shows a cross-sectional interior view of the support frame.

FIG. 7C shows a cross-sectional interior view of the support frame 21. The relative orientation and placement of the composite sound panel assembly including the diaphragm 15, the moving coil module 16, and the edge material 17 is also provided. Additionally, the relative placement of the magnet assembly is also provided, which may include the magnet support frames 1.

The support frame 21 may contact an edge of the edge material 17. The edge material may be formed from foam rubber edging. Optionally, the support may contact one side of a U-shaped trough cross-section of the edge material. A diaphragm 15 may contact the other side of the U-shaped trough cross-section of the edge material. The support frame may surround an outer edge of the edge material, while the edge material may surround the diaphragm, which may contact an inner edge of the edge material. The diaphragm may be stretched out and supported by the edge material and the support frame. The diaphragm may be held in tension.

A moving coil module 16 may be attached to the diaphragm 15. Optionally, one, two or more moving coil modules may be attached to the diaphragm. Each moving coil may include an encapsulated PCB substrate with conductor traces thereon. The conductor traces may form a coil on the PCB substrate. The moving coil module may extend from a surface of the diaphragm (e.g., is not flat against a surface of the diaphragm). The moving coil module may be at any angle relative to the surface of the diaphragm. The moving coil module may be suspended substantially orthogonally relative to the diaphragm. Optionally, the moving coil module is not parallel relative to the diaphragm. The moving coil module may be suspended within a magnet assembly. The magnet assembly may include a pair of magnetic pole in-line assemblies, each comprising a magnet support frame 1 and one or more magnets. The magnet support frames may be formed as steel T-bars. An air gap may be provided between the T-bars. The moving coil module may be suspended within the air gap.

Figure 7D:
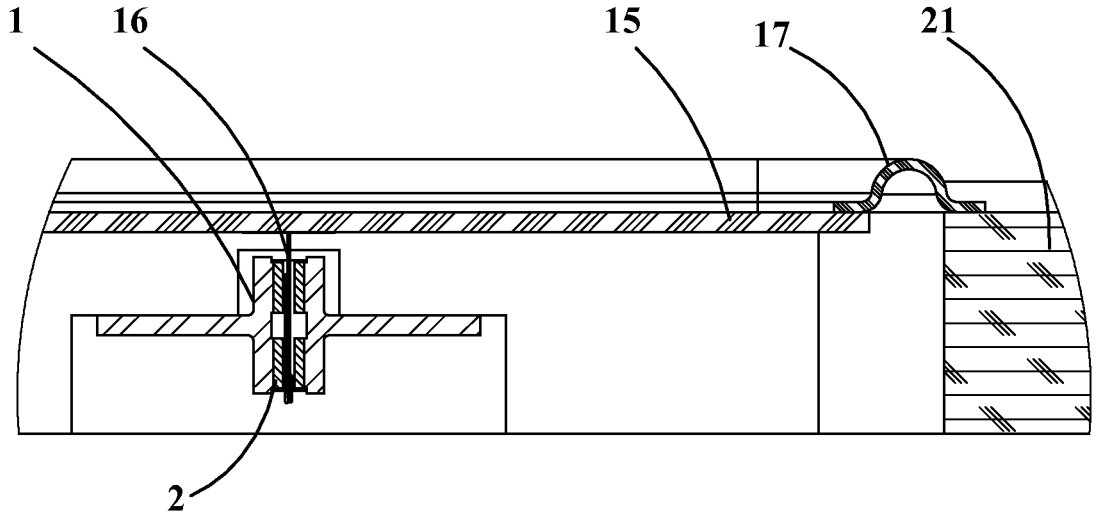
FIG. 7D shows a close up of the cross-sectional interior view of the support frame.

FIG. 7D shows a close up of the cross-sectional interior view of the support frame 21. As previously described the support frame may support an edge material 17 which may in turn support a diaphragm 15 that is stretched out. The edge material may have a dampening effect when the diaphragm vibrates. The support frame and edge material may help hold the diaphragm at a desired tension.

A moving coil module 16 may be attached to the diaphragm 15 and used to drive vibration of the diaphragm, which generates the sound provided by loudspeaker. The moving coil module may be suspended within a magnet assembly. The magnet assembly may optionally have a fixed position relative to the support frame 21. The magnet assembly may include a pair of magnet pole in-line assemblies, which may each include a magnet support frame 1 which may hold one or more magnets 2 thereon. In some embodiments, the magnet support frames may be T-bars, each supporting two or more longitudinal rows of magnets. The magnets may be permanent magnets which may be strong, permanent, rectangular, and may have neodymium composition. A quadrupole magnet assembly may be created. One or more spacers may be provided to position the magnet pole in-line assemblies relative to one another. An air gap may be provided between the magnet pole in-line assemblies. Thus, an air gap may be provided between the rows of magnets supported by different support frames.

The moving coil module 16 may be positioned within the air gap between the different support frames 16. The moving coil module may include a PCB substrate having a conductor trace. The conductor trace may be provided on the PCB substrate as a coil. The coil may have a racetrack shape and may include multiple windings. The conductor traces may be positioned between the rows of magnets 2 supported by the magnet support frames 1. A magnetic field may be generated by the magnets of the magnet support assembly. The moving coil module may naturally levitate between the magnets of the magnet support assembly. The flow of current to the conductor traces may be controlled, which may cause the conductor traces to move relative to the magnets. The movement of the conductor traces on the PCB may cause the moving coil module to move, which may in turn cause the vibrations on the diaphragm. Optionally, one or more ferromagnetic strips may be positioned on the conductor traces, which may assist with controlling or tuning the magnetic field. The ferromagnetic strips may be encapsulated with the PCB substrate and coil using a non-conductive material to form the moving coil module. The ferromagnetic strips may also be positioned between the rows of magnets supported by different magnet support frames.

Figure 8A:
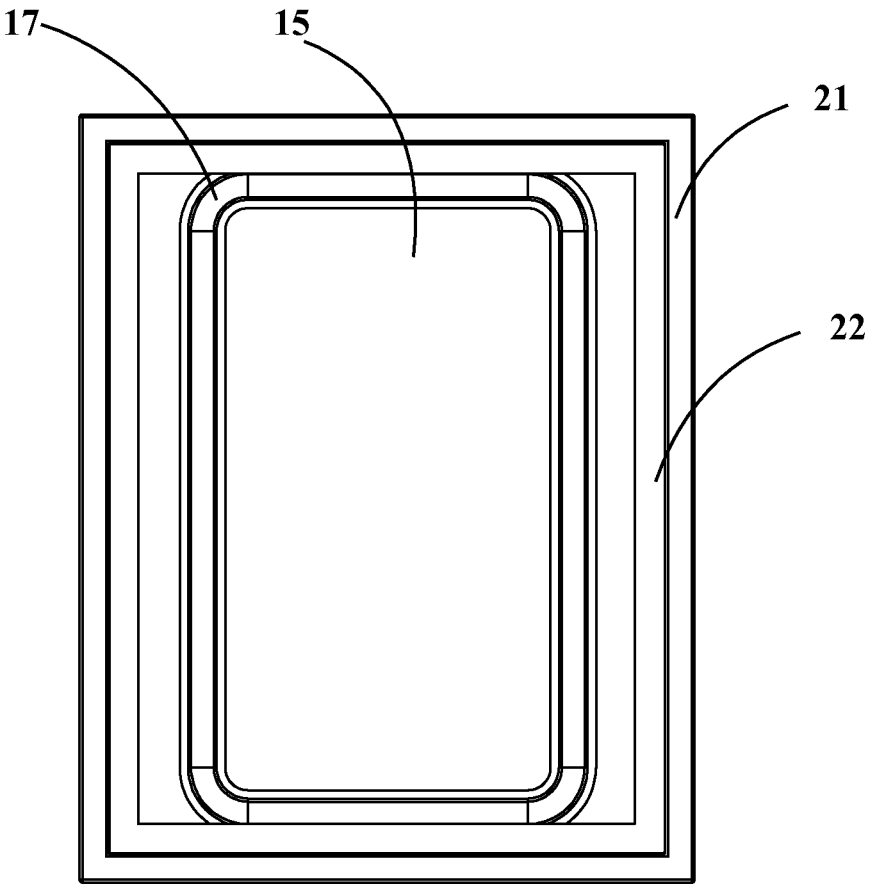
FIG. 8A shows a top external view of a loudspeaker in accordance with an embodiment of the invention.

FIG. 8A shows a top external view of a loudspeaker in accordance with an embodiment of the invention. The loudspeaker may have a diaphragm 15, surrounded by a polyethylene (PE) rubber or other rubber foam around the diaphragm edge 17, a support frame 21 and (showing from this top view) a recessed ledge 22 surrounding a hollow or empty central region of the support frame where the attachment area resides for placing a dust-cover (which may optionally be an artistic image cover) with permanent or temporary affixation.

Figure 8B:
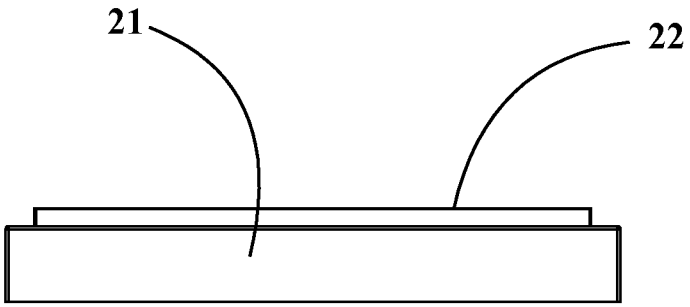
FIG. 8B shows a side view of the loudspeaker.

FIG. 8B shows a side view of the loudspeaker. The side-view may include the support frame 21 and the central area that is hollow 22.

Figure 8C:
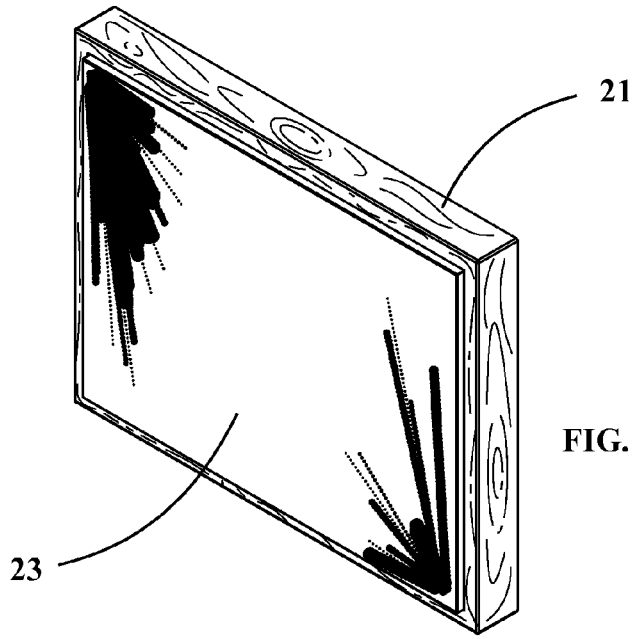
FIG. 8C shows a front, oblique view of the loudspeaker with a dust cover.

FIG. 8C shows a front, oblique view of the loudspeaker with a dust cover. The loudspeaker may have a support frame 21 with the dust cover 23. The dust cover may optionally be formed of artistic print-on silk. Any design or image may be provided on the dust cover. Alternatively, no design or image needs to be printed on the dust cover. The dust cover may be affixed to a smaller tensioning frame that fits precisely within the recessed region in the support frame 21 for permanent, temporary or removal attachment. In one embodiment the loudspeakers may be flat-panel loudspeakers that can be mounted on a wall and area substantially like art in a picture frame. The dust cover may have an artistic image thereon which may permit the loudspeaker function as an art piece and as a loudspeaker. In some instances, the loudspeaker functionalities may be visually hidden so that a viewer of the loudspeaker may not realize that the loudspeaker is more than a visual painting, decoration, or art.

Figure 8D:
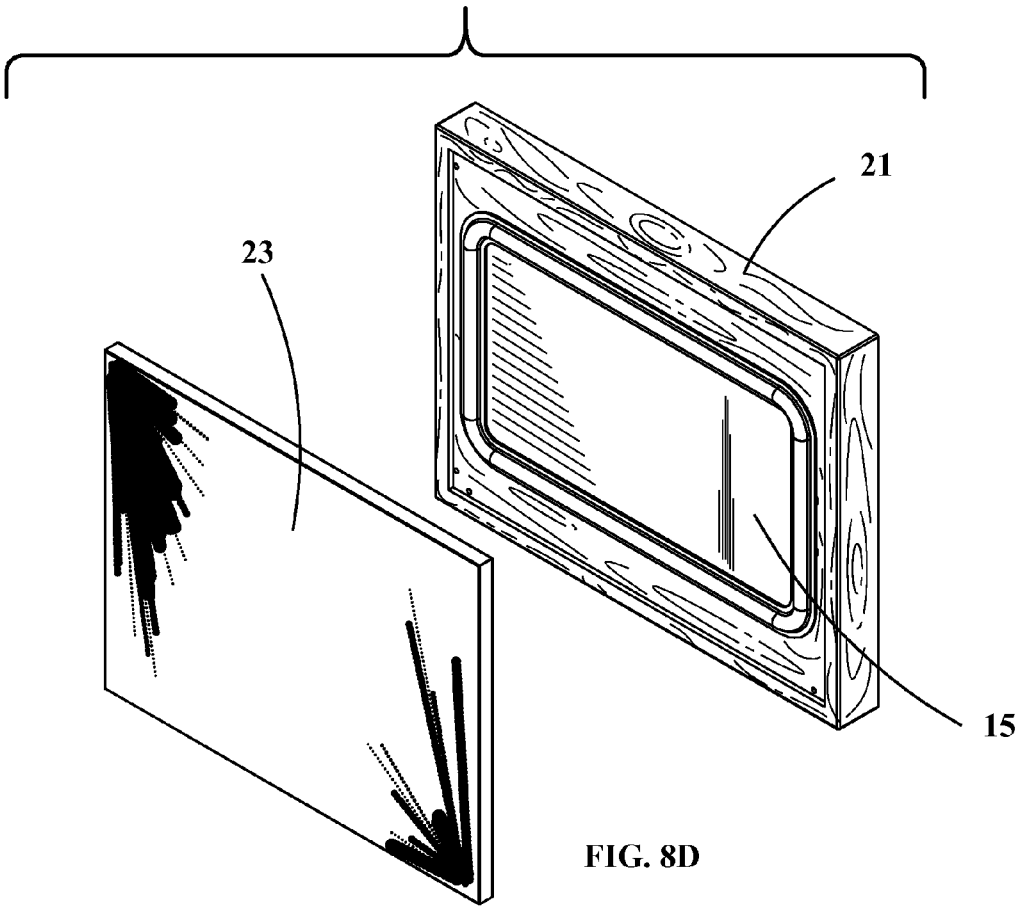
FIG. 8D shows an interior front, oblique view of the loudspeaker along with a front oblique view of the dust cover.

FIG. 8D shows an exploded front, oblique view of the loudspeaker with a dust cover. The loudspeaker may have a support frame 21, the dust cover (e.g., digital printed-on-silk art cover) 23, and a composite sound panel subassembly, which may include a diaphragm 15.

The magnet assembly for the electromagnetic coil driver system (e.g., as shown in FIG. 1A 1B, 2A, 2B) may comprise a magnet support frame (e.g., long mild steel T-bar) 1, and multiples of rectangular high gauss permanent magnets 2, arranged in two rows. The first row of the magnets 2 may be oriented with the North poles faced up. The second row of the magnets 2 may be oriented with the South poles faced up. All magnets 2 may be attached (e.g., glued) to the steel T-bar 1, optionally by use of high strength epoxy to fix their positions (e.g., FIG. 1B, 2B).

A cross sectional quadrupole magnetic assembly is illustrated in FIGS. 2A and 2B. Two steel T-bars 1, with their pre-installed magnets 2, are assembled together and separated by two end spacers 3. The magnet assembly may provide a magnetic field that may aid in driving movement of the diaphragm 15. A moving coil module may interact with the magnetic field provided by the magnet assembly, and may move relative to the magnet assembly, thus effecting vibrations of the diaphragm.

One or more moving coil module may be attached to a diaphragm on a side of the diaphragm opposing the side of the diaphragm facing the dust cover. The diaphragm may be oriented to be substantially parallel to the dust cover. When a loudspeaker is mounted onto a surface, the dust cover may be provided on the exposed side away from the surface. The diaphragm may be provided between the dust cover and the surface. The moving coil module and magnet assembly may be provided between the diaphragm and the surface. The surface may optionally be a wall, ceiling, floor, surface of furniture or other structure, or any other surface.

In some embodiments, a single diaphragm may be provided for a loudspeaker. Alternatively, multiple diaphragms may be provided within a single loudspeaker. Each diaphragm may optionally have one or more respective moving coil modules and magnet assemblies. In some instances, different diaphragms may be used to provide different ranges of sound (e.g., lower pitched sounds vs. higher pitched sounds).

It should be understood from the foregoing that, while particular implementations have been illustrated and described, various modifications can be made thereto and are contemplated herein. It is also not intended that the invention be limited by the specific examples provided within the specification. While the invention has been described with reference to the aforementioned specification, the descriptions and illustrations of the preferable embodiments herein are not meant to be construed in a limiting sense. Furthermore, it shall be understood that all aspects of the invention are not limited to the specific depictions, configurations or relative proportions set forth herein which depend upon a variety of conditions and variables. Various modifications in form and detail of the embodiments of the invention will be apparent to a person skilled in the art. It is therefore contemplated that the invention shall also cover any such modifications, variations and equivalents.

What is claimed is:

1. A loudspeaker comprising:

a diaphragm configured to vibrate to create sounds;

a magnet assembly comprising a plurality of magnets and an air gap between the magnets; and a moving coil module comprising an electrically insulating substrate that is patterned with an electrically conducting material forming a coil shaped conductor trace thereon, wherein the substrate and the conductor trace are located in the air gap between the magnets and the moving coil module is attached to the diaphragm and the substrate extends from a surface of the diaphragm, wherein the moving coil module further comprises two or more ferromagnetic strips that contact the conductor trace, and wherein the two or more ferromagnetic strips, the conductor trace, and the electrically insulating substrate are encapsulated by a non-conductive cover that provides attachment of the coil module to the diaphragm.

2. The loudspeaker of claim 1 wherein the magnet assembly includes a plurality of T-shaped magnet support frames, and the plurality of magnets are supported by the magnet support frames.

3. The loudspeaker of claim 2 wherein the magnet assembly includes a pair of T-shaped magnet support frames, and each T-shaped magnet support frame supports at least two longitudinal rows of magnets.

4. The loudspeaker of claim 3 wherein magnets in a first row of magnets of the at least two longitudinal rows have a polarity opposite polarity of magnets in a second row of magnets of the at least two longitudinal rows.

5. The loudspeaker of claim 3 wherein each of the pair of T-shaped magnet support frames comprises a first planar portion and a second planar portion substantially orthogonal to the first planar portion, wherein the at least two longitudinal rows of magnets are attached to a surface of the first planar portion opposite a surface of the first planar that comes into contact with the second planar portion.

6. The loudspeaker of claim 1 wherein the substrate is a printed circuit board (PCB) substrate.

7. The loudspeaker of claim 6 wherein the conductor trace is etched or printed onto, or embedded or partially embedded into the PCB substrate.

8. The loudspeaker of claim 6 wherein the PCB board is formed from flexible or semi-rigid materials.

9. The loudspeaker of claim 1 wherein the conductor trace is formed of metallized trace lines forming a racetrack shaped coil layout.

10. The loudspeaker of claim 1 wherein the conductor trace has a variable cross section area along the length of the conductor trace.

11. The loudspeaker of claim 1 wherein a conductive material coating is added to the conductor trace, thereby decreasing impedance of the conductor trace.

12. The loudspeaker of claim 1 wherein at least a single layer of the conductor trace is provided to form the coil, and wherein the conductor trace does not intersect itself.

13. The loudspeaker of claim 1 wherein the two or more ferromagnetic strips are positioned so that they are not in contact with one another.

14. The loudspeaker of claim 13 wherein the two or more ferromagnetic strips are aligned substantially parallel to one another.

15. The loudspeaker of claim 1 wherein the two or more ferromagnetic strips contact the conductor trace on a side opposite the substrate.

16. A method of forming a moving coil module for a loudspeaker having a diaphragm configured to vibrate to create sounds, a magnet assembly comprising a plurality of magnets and an air gap between the magnets, and the moving coil module in the air gap and attached to the diaphragm, said method comprising:

selecting a desired characteristic of a magnetic field that includes the magnets;

providing an electrically insulating substrate dimensioned based on the selected desired characteristic of the magnetic field;

selecting dimensions and an arrangement of an electrically conducting material forming a coil shaped conductor trace based on the selected desired characteristic of the magnetic field;

patterning the electrically insulating substrate with the conductor trace thereon in accordance with the selected dimensions and arrangement; and providing two or more ferromagnetic strips contacting the conductor trace, wherein the two or more ferromagnetic strips, the conductor trace, and the electrically insulating substrate are encapsulated by a non-conductive cover.

17. The method of claim 16 wherein the electrically insulating substrate is a printed circuit board (PCB) substrate and further comprising etching, printing, embedding, or partially embedding the conductor trace on the PCB substrate.

18. The method of claim 17 further comprising encapsulating the PCB substrate and the conductor trace in the non-conductive cover; and baking the PCB substrate, conductor trace, and non-conductive cover at a temperature of least 100 degrees C.

19. The method of claim 16 wherein the conductor trace is patterned to form a racetrack coil that forms a single layer and does not intersect itself.

20. The method of claim 19 wherein the conductor trace is patterned to provide selected spacing between each wind of the coil.

* * * * *